US009780495B2

(12) United States Patent
Wu et al.

(10) Patent No.: US 9,780,495 B2
(45) Date of Patent: Oct. 3, 2017

(54) PLUG CONNECTOR ASSEMBLY HAVING A STRENGTHENED METAL SHELL

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/408,688

(22) Filed: Jan. 18, 2017

(65) Prior Publication Data

US 2017/0207580 A1 Jul. 20, 2017

(30) Foreign Application Priority Data

Jan. 18, 2016 (CN) ..... 2016 1 0030000

(51) Int. Cl.

| | |
|---|---|
| ***H01R 13/66*** | (2006.01) |
| ***H01R 13/6581*** | (2011.01) |
| ***H01R 13/717*** | (2006.01) |
| ***H01R 24/60*** | (2011.01) |
| ***H01R 13/58*** | (2006.01) |
| ***H01R 12/51*** | (2011.01) |
| ***H01R 4/02*** | (2006.01) |
| ***H01R 13/502*** | (2006.01) |
| *H01R 107/00* | (2006.01) |

(52) U.S. Cl.

CPC ..... *H01R 13/6581* (2013.01); *H01R 4/023* (2013.01); *H01R 12/515* (2013.01); *H01R 13/502* (2013.01); *H01R 13/5804* (2013.01); *H01R 13/7175* (2013.01); *H01R 24/60* (2013.01); *H01R 2107/00* (2013.01)

(58) Field of Classification Search

CPC ..... H01R 13/6581; H01R 2107/00; H01R 13/5804; H01R 13/7175; H01R 24/60; H01R 12/515; H01R 4/023; H01R 13/502; H01R 13/516; H01R 13/6473

See application file for complete search history.

(56) References Cited

U.S. PATENT DOCUMENTS

| | | | | |
|---|---|---|---|---|
| 8,900,013 | B2 | 12/2014 | Li et al. | |
| 2014/0335729 | A1 | 11/2014 | Little et al. | |
| 2015/0031246 | A1* | 1/2015 | Wu | H01R 13/6473 439/660 |
| 2016/0285214 | A1* | 9/2016 | Chen | H01R 27/00 |
| 2016/0372858 | A1* | 12/2016 | Huo | H01R 13/516 |

* cited by examiner

*Primary Examiner* — Jean F Duverne

(74) *Attorney, Agent, or Firm* — Wei Te Chung; Ming Chieh Chang

(57) ABSTRACT

A plug connector assembly includes: a mating member; a cable; a printed circuit board (PCB) interconnected between the mating member and the cable; a metal shell enclosing the PCB, a rear of the mating member, and a front of the cable, the metal shell including an upper shell part and a lower shell part both welded to the rear of the mating member; and an insulative outer shell enclosing the metal shell, the rear of the mating member, and the front of the cable, wherein the upper shell part is welded to the lower shell part.

8 Claims, 10 Drawing Sheets

FID. 5

PLUG CONNECTOR ASSEMBLY HAVING A STRENGTHENED METAL SHELL

CROSS-REFERENCE TO RELATED APPLICATIONS

This patent application relates to a U.S. patent application Ser. No. 15/149,199, filed on May 9, 2016, entitled "PLUG CONNECTOR ASSEMBLY HAVING THINNER OUTER SHELL," which is assigned to the same assignee as this application.

BACKGROUND OF THE INVENTION

1. Field of the Invention

The present invention relates to a plug connector assembly having a laser beam welded metal shell to obtain a strengthened structure.

2. Description of Related Arts

Laser beam welding or spot welding is widely used to join multiple pieces of metal. For example, U.S. Patent Application Publication No. 2014/0349514, published on Nov. 27, 2014, shows welding of an upper and lower shells to a rear end of a mating member. The upper and lower shells themselves are latched to each other.

SUMMARY OF THE INVENTION

A plug connector assembly comprising: a mating member; a cable; a printed circuit board (PCB) interconnected between the mating member and the cable; a metal shell enclosing the PCB, a rear of the mating member, and a front of the cable, the metal shell including an upper shell part and a lower shell part both welded to the rear of the mating member; and an insulative outer shell enclosing the metal shell, the rear of the mating member, and the front of the cable; wherein the upper shell part is welded to the lower shell part. Structural strength of the metal shell is ensured by welding connection of the upper and lower shell parts to each other.

DETAILED DESCRIPTION OF THE PREFERRED EMBODIMENT

Figure 1:
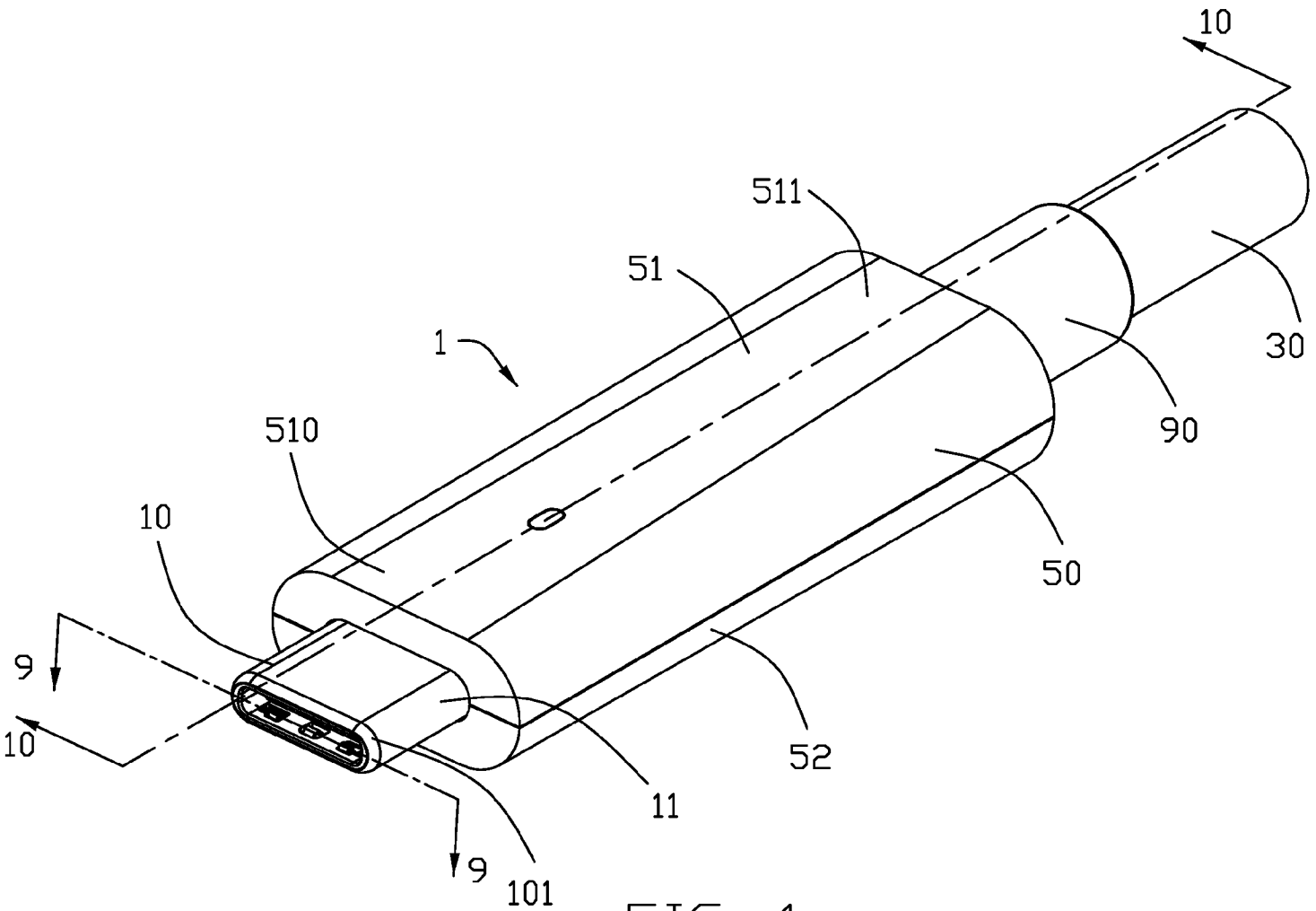
FIG. 1 is a perspective view of a plug connector assembly in accordance with the present invention.
Figure 2:
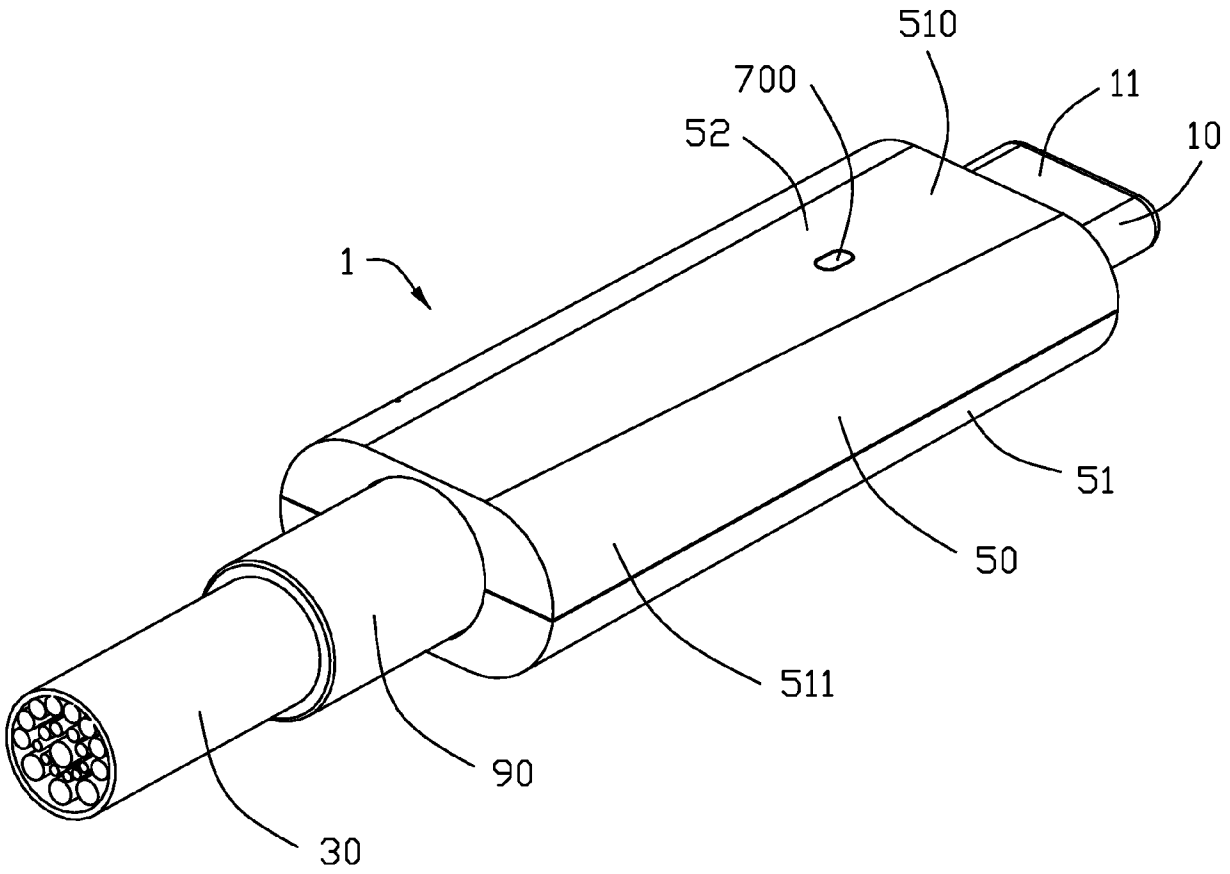
FIG. 2 is another perspective view of the plug connector assembly.
Figure 3:
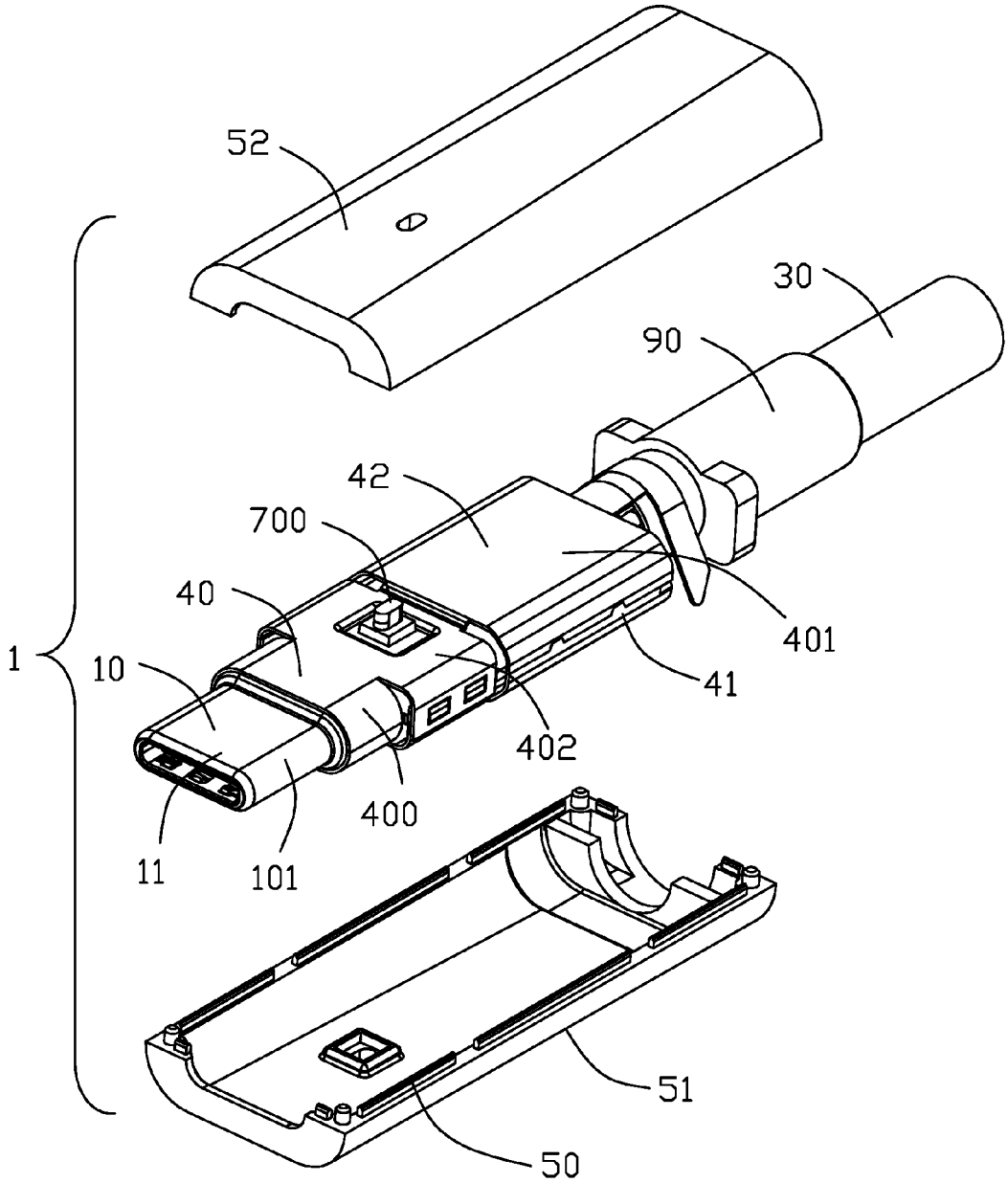
FIG. 3 is an exploded view of the plug connector assembly.
Figure 4:
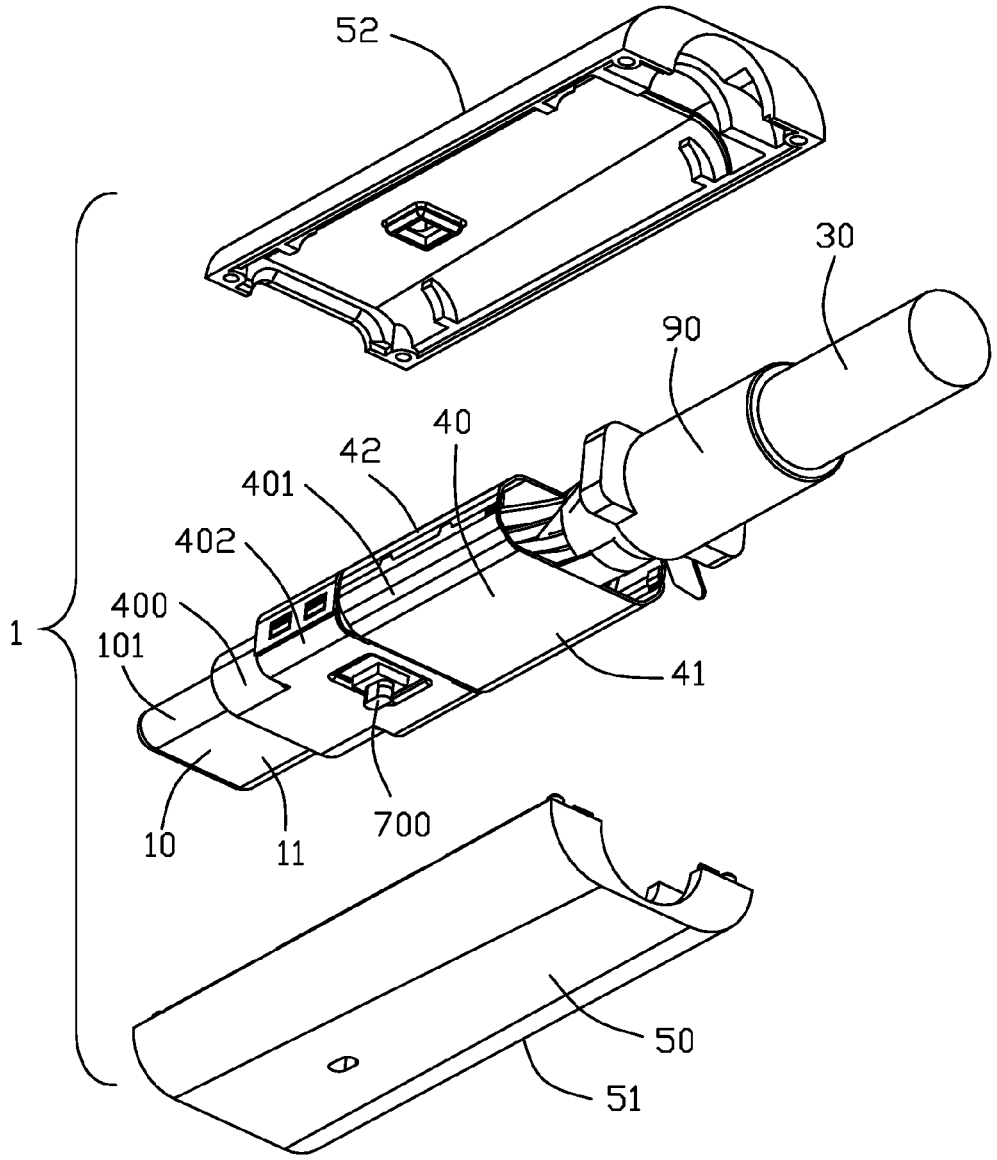
FIG. 4 is another exploded view of the plug connector assembly.
Figure 5:
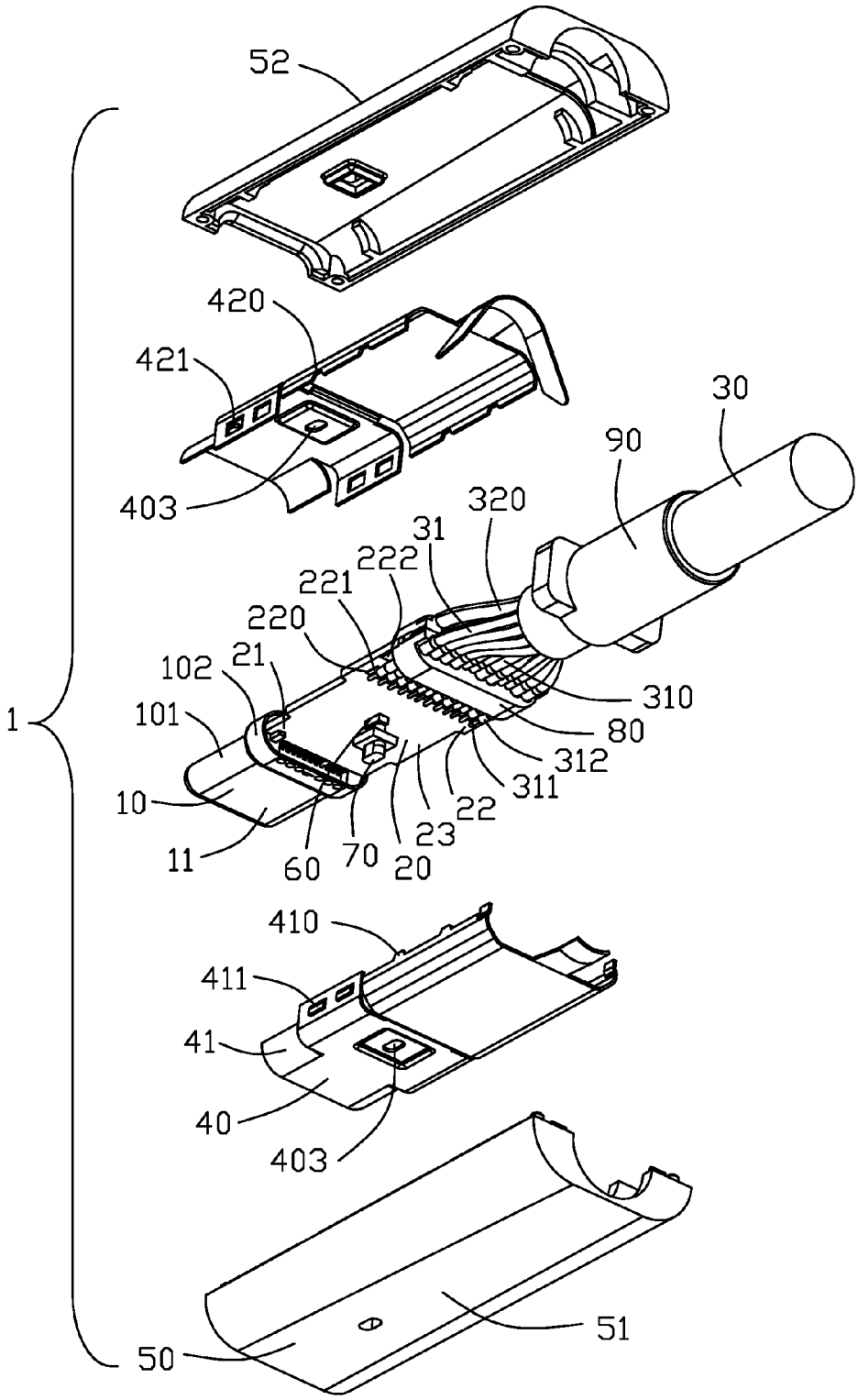
FIG. 5 is a further exploded view of the plug connector assembly in FIG. 4.
Figure 6:
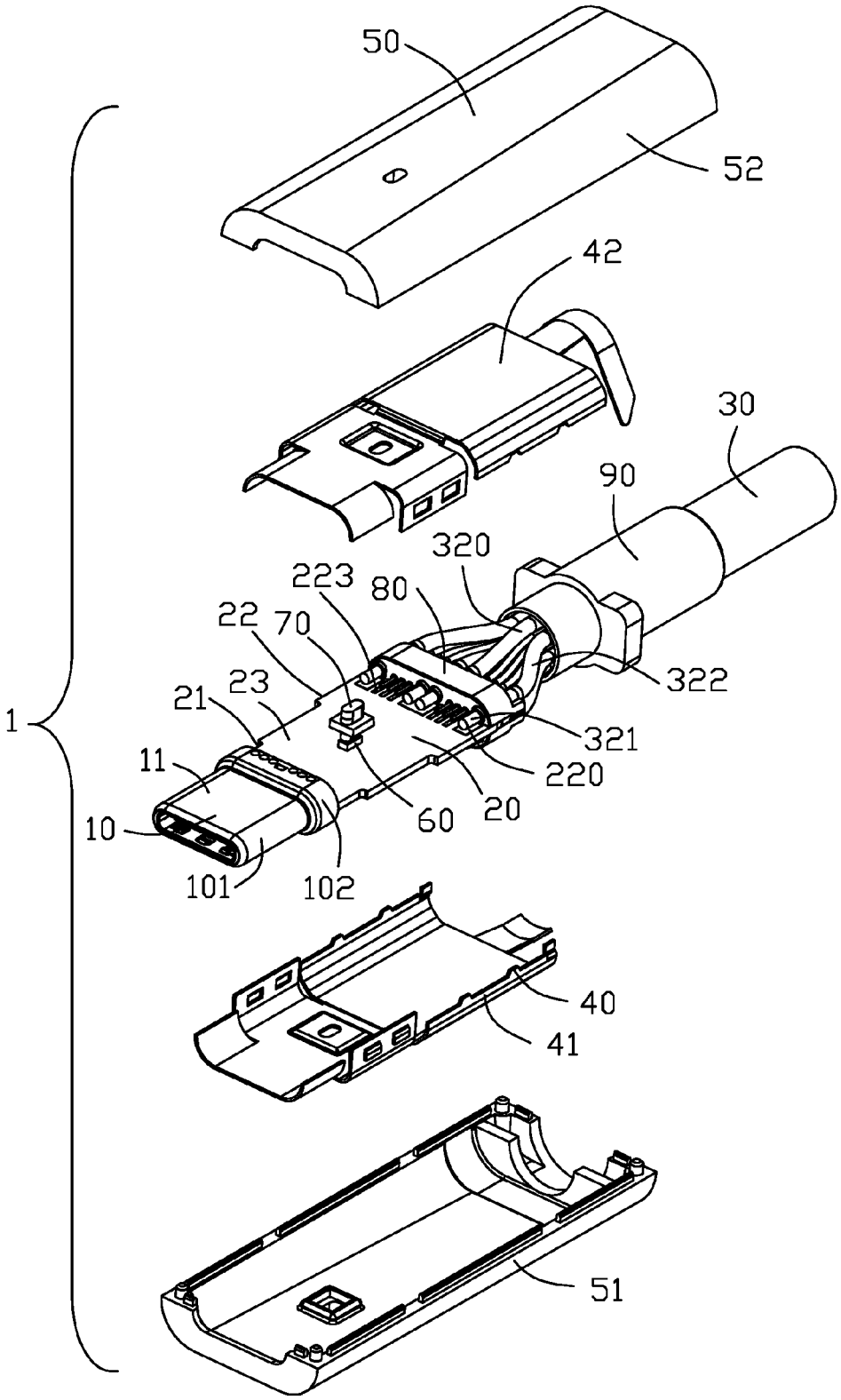
FIG. 6 is a further exploded view of the plug connector assembly in FIG. 3.
Figure 7:
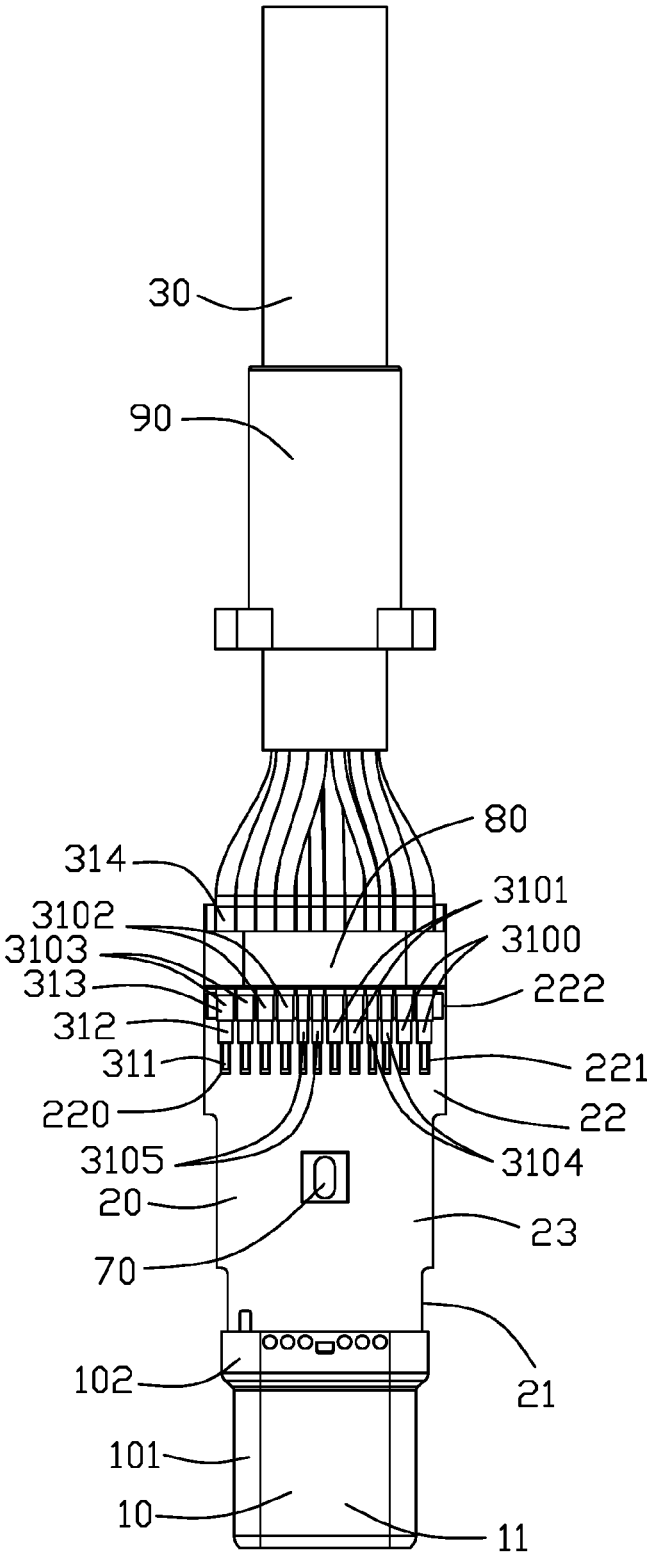
FIG. 7 is a bottom plan view of the plug connector assembly in FIG. 6, omitting a metal shell and an insulative outer shell thereof.
Figure 8:
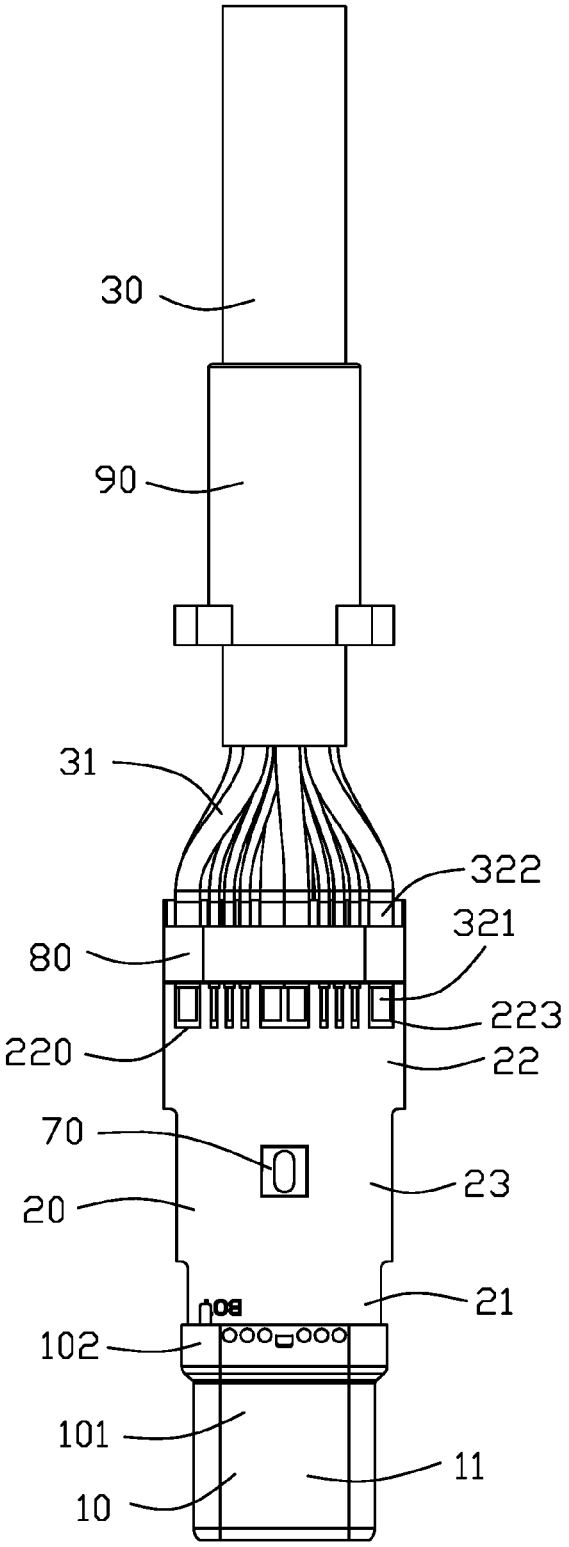
FIG. 8 is a view similar to FIG. 7 but viewed from top.
Figure 9:
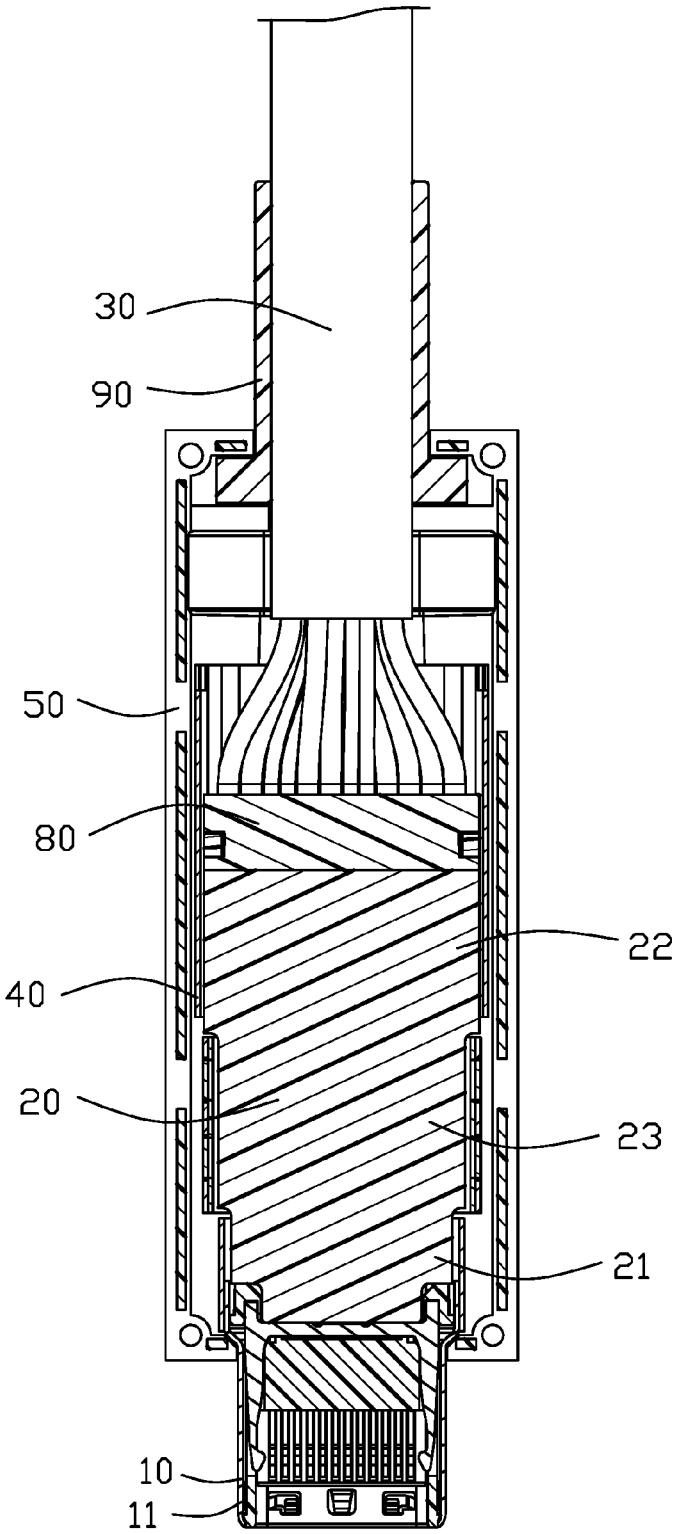
FIG. 9 is a cross-sectional view of the plug connector assembly in FIG. 1 taken along line A-A.
Figure 10:
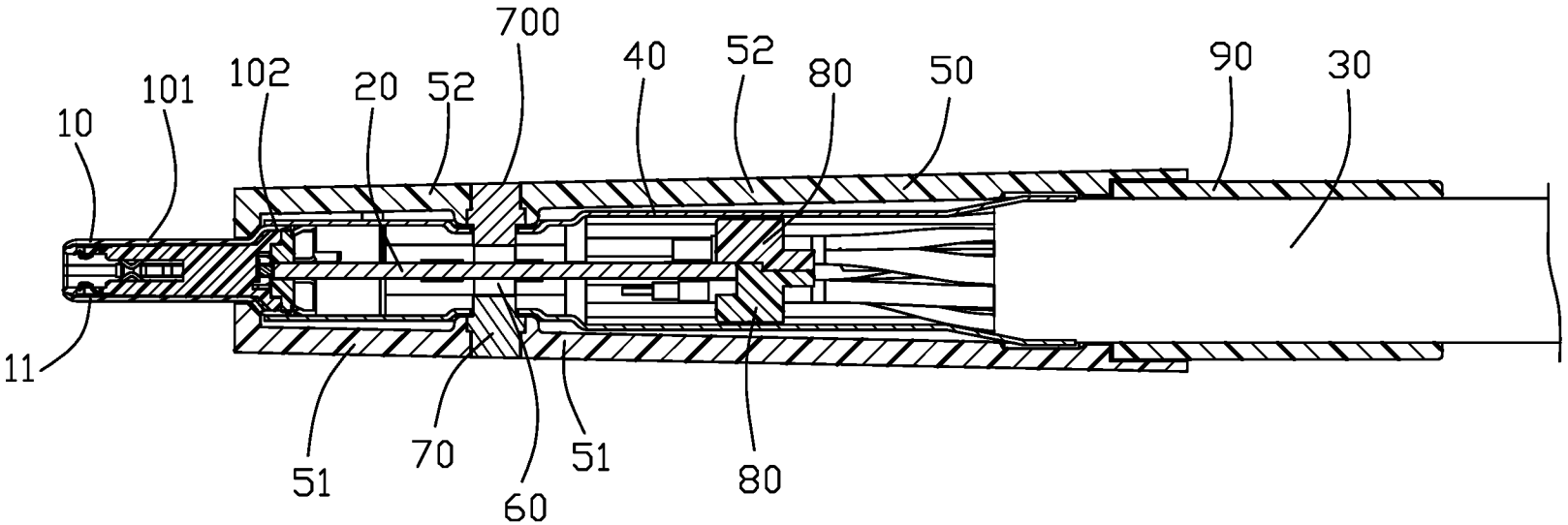
FIG. 10 is a cross-sectional view of the plug connector assembly in FIG. 1 taken along line B-B.

Referring to FIGS. 1 to 10, a plug connector assembly 1 adapted to plug into a receptacle in two orientations comprises a mating member 10, a printed circuit board (PCB) 20 electrically connected with the mating member 10, a cable 30 electrically connected with the PCB 20, a metal shell 40 connected with the mating member 10 and the cable 30 and enclosing the PCB 20, and an outer shell 50 disposed outside the metal shell 40. The plug connector assembly 1 further comprises a pair of light emitting members 60 disposed at two opposite sides of the PCB 20, respectively, and a pair of light guide members 70 for guiding the light from the light emitting members 60 to outside for viewing by a user. The cable 30 is electrically connected with the mating member 10 through the PCB 20.

The mating member 10 comprises a front mating end 101 for being inserted into a mating receptacle and a rear mating end 102 wider in size than the front mating end 101. The mating member 10 includes a metallic shielding 11.

Referring to FIGS. 3 to 10, the PCB 20 comprises a front end 21 for being connected with the mating member 10, a rear end 22 for being soldered with the cable 30, and a middle portion 23 between the front end 21 and the rear end 22. The front end 22 has a width less than a width of either the middle portion 23 or the rear end 22. The width of the middle portion 23 is less than the width of the rear end 22. The rear end 22 of the PCB 20 has two opposite sides both soldered with the cable 30. One side of the rear end 22 comprises a plurality of first conductive pads 221 arranged in a row along a transverse direction and a second conductive pad 222 disposed behind the first conductive pads 221. The second conductive pad 222 extends beyond the two ends of the row of first conductive pads 221 along the transverse direction. Each of the first conductive pads has a same width. The other side of the rear end 22 comprises a plurality of third conductive pads 223 arranged in a row along the transverse direction.

The cable 30 comprises a plurality of wires 31. In this embodiment, the cable 30 has an outer diameter 5.6 mm. The plug connector assembly 1 further comprises one or more spacers 80 to arrange the wires into first wires 310 for being soldered on the one side of the rear end 22 of the PCB 20 and second wires 320 for being soldered on the other side of the rear end 22 of the PCB 20. The first wires 310 are all coaxial wires. Each of the first wires 310 comprises a center conductor 311, an inner insulative layer 312 enclosing the center conductor 311, a shielding layer 313 enclosing the inner insulative layer 312, and an outer insulative layer 314 enclosing the shielding layer 313. There are twelve first wires 310. Eight of the twelve wires 310 have diameters larger than the remaining four wires 310. The number of the first conductive pads 221 is equal to the number the first wires 310. The eight larger wires include a first differential pair 3100 for USB (Universal Serial Bus) 3.1 signals, a second differential pair 3101 for USB 3.1 signals, a third differential pair 3102 for high speed DP (Display Port) signals, and a fourth differential pair 3103 for high speed DP signals. The four smaller wires include a fifth pair 3104, for low speed DP signals, disposed between the first differential pair 3100 and the second differential pair 3101, and a sixth pair 3105, for USB 2.0 signals, disposed between the first and second differential pairs 3100 and 3101 and the third and fourth differential pairs 3102 and 3103. With the fifth pair 3104 disposed between the first and second differential pairs 3100 and 3101, grounding pad is not required for reducing cross talk. With the sixth pair 3105 disposed between the first and second differential pairs 3100 and 3101 and the third and fourth differential pairs 3102 and 3103, grounding pad is not required for reducing cross talk. Therefore, the PCB 20 may be made smaller. Each of the center conductors 311 of the first wires 310 is soldered with a corresponding one of the first conductive pads 221. The shielding layers 313 of the first wires 310 are soldered to the second conductive pad 222. All of the central conductors 311 of the first wires 310 are soldered with the first conductive pads 221 at a same time, and all of the shielding layers 313 of the first wires 310 are soldered with the second conductive pad 222 at a same time.

The second wires 320 include ten single core wires. Each of the coaxial wires comprises a center conductor 321 and an insulative layer 322 enclosing the center conductor. Four of the single core wires 320 have outer diameters larger than the others and are used to transmit power as high as 130 watts. The conductors 321 of the second wires 320 are soldered on the third conductive pads 223. The number of the third conductive pads 223 is less than the number of the second wires 320. Three of the third conductive pads 223 have a width larger than the others. Two of the four conductors 321 having larger outer diameters are soldered on one of the three larger third conductive pads 223 at a middle, and the other two larger conductors 321 are soldered on the other two larger third conductive pads 223 at two outer sides.

Referring to FIGS. 3 to 10, the metal shell 40 comprises an upper shell part 41 and a lower shell part 42 attached to the upper shell part 41. The metal shell 40 has a front portion 400 welded to a rear of the mating member 10, a rear portion 401 enclosing a front of the cable 30, and an intermediate portion 402 between the front and rear portions 400 and 401. The front portion 400 has a width smaller than the intermediate portion 402; the intermediate portion 402 has a width smaller than the rear portion 401. The rear portion 401 of the upper shell part 41 has one or more protrusion 410 at two side edges thereof. The rear portion 401 of the lower shell part 42 has, at two side edges thereof, one or more recesses 420 engaged with the protrusions 410 for subsequent laser beam spot welding. The intermediate portion 402 of the upper shell part 41 has one or more tabs or protrusions 411 and the intermediate portion 402 of the lower shell part 42 has one or more holes or recesses 421 receiving the tabs or protrusions 411. A respective hole 403 is provided in each of the upper and lower shell parts 41 and 42 for accommodating the light guide member 70.

Referring to FIGS. 1 to 10, the cable 30 is provided with a strain relief 90. The outer shell 50 comprises an upper half 51 and a lower half 52. The upper half 51 comprises a front portion 510 enclosing the rear of the mating member 10, and a rear portion 511 coupled to the strain relief 90. The strain relief 90 has an outer diameter of 7 mm. The thinnest portion along a vertical direction of the front portion 510 of the outer shell 50 is 6.5 mm. The thickest portion along the vertical direction of the rear portion 511 of the outer shell 50 is 8 mm. The outer shell 50 has a tapered outer contour relative to the plane of the PCB 20 with a gradually decreasing dimension from a rear toward a front thereof. Each of the outer shell 50 and the PCB 20 has three portions of different dimensions to minimize gaps. The outer shell 50 is over molded with the metal shell 40.

The light emitting member 60 can be an LED (light emitting diode) or other suitable optical sources. The light guide member 70 has a display face 700 for viewing. The display face h700 is also sloped to match the contour of the outer shell 50.

Structural strength of the metal shell 40 is ensured by welding connection of the upper and lower shell parts 41 and 42 to each other.

What is claimed is:

1. A plug connector assembly comprising:

a mating member;

a cable;

a printed circuit board (PCB) interconnected between the mating member and the cable;

a metal shell enclosing the PCB, a rear of the mating member, and a front of the cable, the metal shell including an upper shell part and a lower shell part both welded to the rear of the mating member; and an insulative outer shell enclosing the metal shell, the rear of the mating member, and the front of the cable; wherein the upper shell part is welded to the lower shell part;

wherein each of the upper and lower shell parts includes a front portion, a rear portion, and an intermediate portion between the front and rear portions, the intermediate portions of the upper and lower shell parts are latched to each other; wherein one of the rear portions of the upper and lower shell parts has a protrusion, and the other of the rear portions has a recess engaged with the protrusion; wherein the insulative outer shell has a tapered outer contour relative to the plane of the PCB with a gradually decreasing dimension toward a front thereof.

2. A plug connector assembly comprising:

a printed circuit board extending in a horizontal plane defined by a front-to-back direction and a transverse direction perpendicular to each other, and defining opposite front and rear ends opposite to each other in the front-to-back direction, said printed circuit board defining a front region, a rear region and a middle region between said front region and said rear region in the front-to-back direction wherein a dimension in the transverse direction of the front region is smaller than that of the middle region which is smaller than that of the rear region;

a mating member electrically and mechanically connected to the front end;

a cable electrically and mechanically connected to the rear end; and a metal shell enclosing the printed circuit board, a rear portion of the mating member and a front portion of the cable, said metal shell including a front section, a rear section and a middle section between said first section and said rear section in said front-to-back direction; wherein said front section, said middle section and said rear section compliantly intimately located beside the corresponding front region, the middle region and the rear region so as to prevent forward movement of the printed circuit board relative to the shell; wherein the front section grasps a rear end of the mating member, the middle section confines a light emitting device assembly mounted on the printed circuit board, and the rear section encloses a corresponding insulative spacer which regulates corresponding wires of the cable; wherein said light emitting device assembly includes a light guide member restrained by the middle section, and a light emitting member mounted upon the middle region of the printed circuit board; further including an outer shell over-molded upon the metallic shell, wherein the light guiding member extends through said outer shell to be exposed to an exterior in the vertical direction.

3. The plug connector assembly as claimed in claim 2, wherein said rear section further includes a clip to clamp the cable.

4. The plug connector assembly as claimed in claim 2, wherein a dimension in a vertical direction perpendicular to both said front-to-back direction and said transverse direction, is larger than that of the second section.

5. The plug connector assembly as claimed in claim 4, wherein the dimension in the vertical direction of the second section is not less than that of the first section.

6. The plug connector assembly as claimed in claim 2, wherein metallic shell includes an upper part and a lower part assembled to each other, each having the corresponding front section, the middle section and the rear section, and wherein the front sections of the upper part and the lower part and the rear sections of the upper part and the lower part are welded while the middle sections of the upper part and the lower part are mechanically engaged with each other.

7. The plug connector assembly as claimed in claim 5, wherein the front sections of both said upper part and said lower part are welded upon the rear end of the mating member.

8. The plug connector assembly as claimed in claim 2, further including an insulative outer shell over-molded upon the metallic shell, wherein said outer shell keeps a same dimension in the transverse direction throughout the front section, the middle section and the rear section while having a tapered configuration along the front-to-back direction in the vertical direction with a small dimension on the front section and a large dimension on the rear section.

* * * * *